US006141427A

United States Patent [19]

Fukuda

[11] Patent Number: 6,141,427

[45] Date of Patent: Oct. 31, 2000

[54] BONE-CONDUCTION SPEAKER

[75] Inventor: Mikio Fukuda, Tokyo, Japan

[73] Assignee: Temco Japan Co., Ltd., Tokyo, Japan

[21] Appl. No.: 09/327,381

[22] Filed: Jun. 8, 1999

[30] Foreign Application Priority Data

Jun. 8, 1998 [JP] Japan ..... 10-159248

[51] Int. Cl.[7] ..... H04R 25/00

[52] U.S. Cl. ..... 381/151; 381/326; 381/396

[58] Field of Search ..... 381/326, 151, 381/396, 417, 412, 380, FOR 130

[56] References Cited

U.S. PATENT DOCUMENTS 2,459,325 1/1949 Knowles ..... 381/417
2,482,044 9/1949 Vernier ..... 381/151

*Primary Examiner*—Huyen Le
*Attorney, Agent, or Firm*—Browdy and Neimark

[57] ABSTRACT

A yoke 1 having a center magnetic pole 2 around which a voice coil is wound is provided, the yoke 1 is extended in four directions, magnets 4 are disposed on two parts 7 and 7 facing to each other among the extensions, respectively, and diaphragm fixing sections 6 are erected on the other two parts 8 and 8 and a diaphragm is fixed on the diaphragm fixing section 6.

8 Claims, 3 Drawing Sheets

BONE-CONDUCTION SPEAKER

BACKGROUND OF THE INVENTION

1. Field of the Invention

The present invention relates to a bone-conduction speaker and more specifically to a speaker of a type for listening to sounds by abutting to a head to transmit vibrations of a diaphragm to the skeleton structure.

2. Description of the Related Art

One as shown in FIG. 6A has been known as a conventional bone-conduction speaker. It comprises a cylindrical case 21 having a diaphragm 22 at a top surface thereof, a cylindrical magnet 23 fitted within the case 21, a yoke 25 having a center magnetic pole 24 at the center and fitted at the lower part of the case 21 and a voice coil 26 disposed so as to surround the center magnetic pole 24 of the yoke 25.

The conventionally known bone-conduction speaker has had the structure as described above and those components are disposed concentrically in order, from the center, of the center magnetic pole 24, the voice coil 26, the magnet 23 and the case 21 as shown in FIG. 6B. Accordingly, in order to increase the diameter of the center magnetic pole 24 and to increase a number of turns of the voice coil 26 to enhance the output efficiency, the magnet 23 and the case 21 surrounding them must be enlarged and the increase of the size of the outer diameter is inevitable.

SUMMARY OF THE INVENTION

Accordingly, it is an object of the invention to provide a bone-conduction speaker whose output efficiency can be increased without increasing the size of the outer diameter.

A secondary object of the invention is to provide a bone-conduction speaker which is fully strong with a simple structure.

The above-mentioned problem has been solved by an inventive bone-conduction speaker in which a yoke having a center magnetic pole around which a voice coil is wound is provided, the yoke is extended in four directions, magnets are disposed on two parts facing to each other among the extensions, respectively, and diaphragm fixing sections are erected on the other two parts and a diaphragm is fixed on the diaphragm fixing section. Normally, the diaphragm has a horizontally long opening at the center part thereof and a plate yoke fixed to the diaphragm is allowed to vibrate within the center opening.

BRIEF DESCRIPTION OF THEDRAWINGS

DESCRIPTION OF THE PREFERRED EMBODIMENTS

Figure 1:
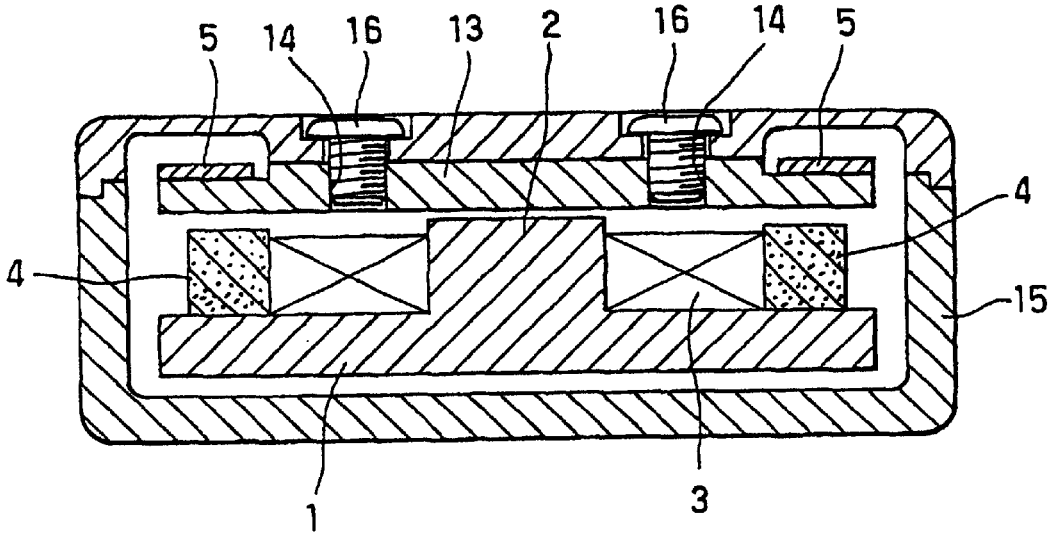
FIG. 1 is a longitudinal section view showing the state in which a bone-conduction speaker of the invention is built into a housing.
Figure 2:
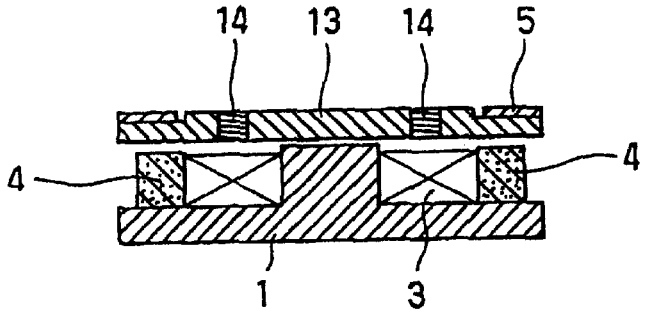
FIG. 2 is a longitudinal section view of the inventive bone-conduction speaker.
Figure 3:
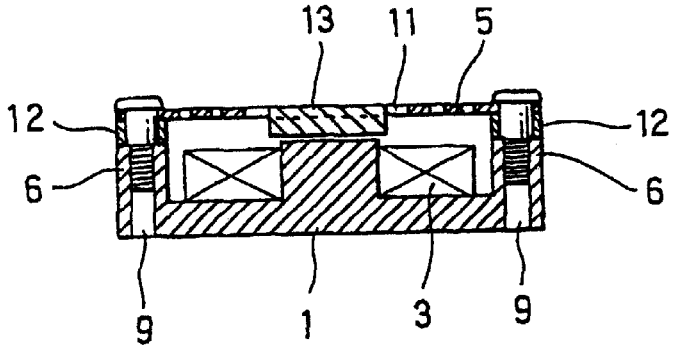
FIG. 3 is a longitudinal section view of the inventive bone-conduction speaker seen from the direction orthogonal to the case of FIG. 2.

An embodiment of the present invention will be explained based on the appended drawings. A bone-conduction speaker of the invention comprises a yoke 1 having a center magnetic pole 2, a donut-like voice coil 3 surrounding the center magnetic pole 2, split magnets 4 disposed on the outside of the voice coil 3 and a diaphragm 5 attached to a diaphragm fixing section 6 of the yoke 1.

The yoke 1 is slightly larger than the voice coil 3 and has extensions in four directions. Among them, two extensions facing to each other are magnet setting sections 7 and 7 and the other two are diaphragm fixing section erecting sections 8 and 8. The rectangular parallelepiped magnets 4 contacting with the voice coil 3 are fixed on the magnet setting sections 7 and 7, respectively. The magnet 4 may be what has a shape curved along the voice coil 3.

Figure 4:
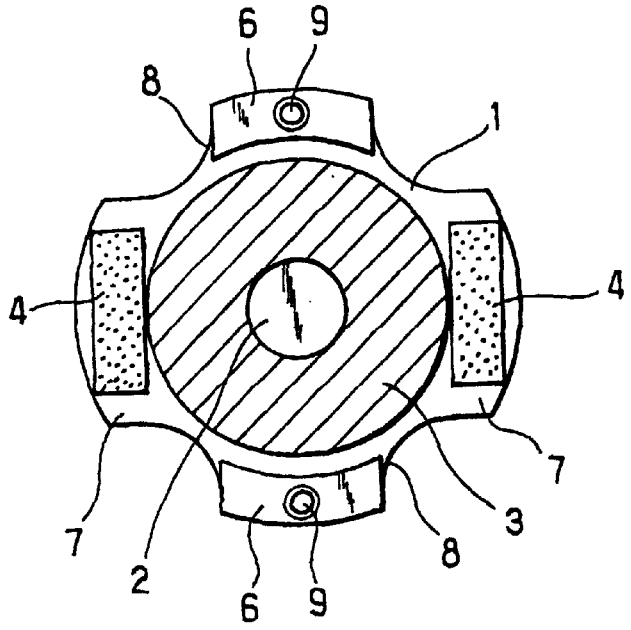
FIG. 4 is a plan view of the inventive bone-conduction speaker in the state in which a diaphragm is removed.
Figure 5:
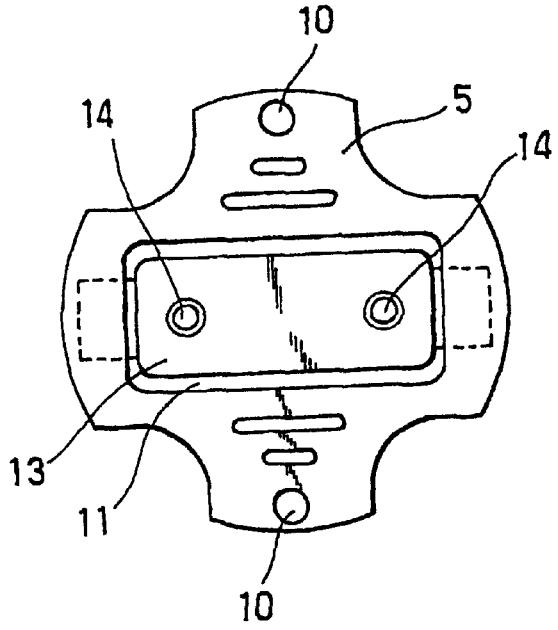
FIG. 5 is a drawing showing the shape of the diaphragm in the inventive bone-conduction speaker.
Figure 6:
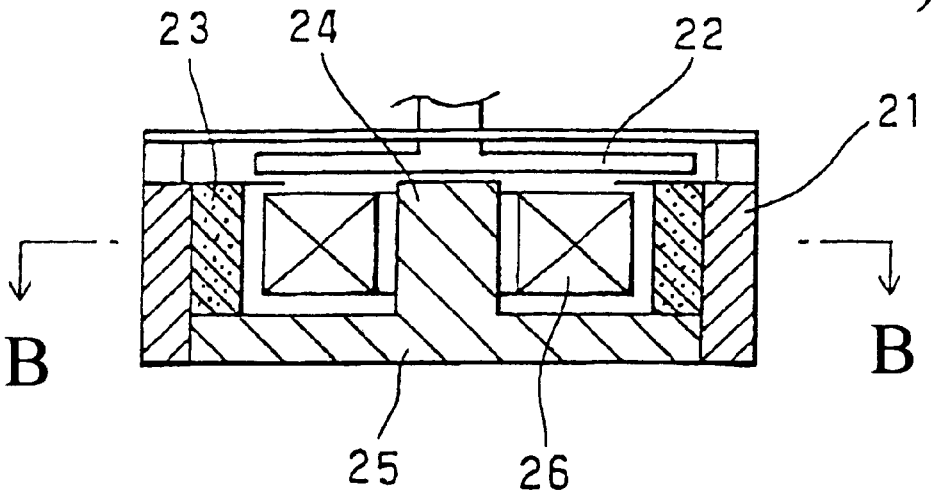
FIG. 6 A (PRIOR ART)
FIGS. 6A, 6B are the longitudinal section views showing the structure of the conventional bone-conduction speaker.
Figure 6:
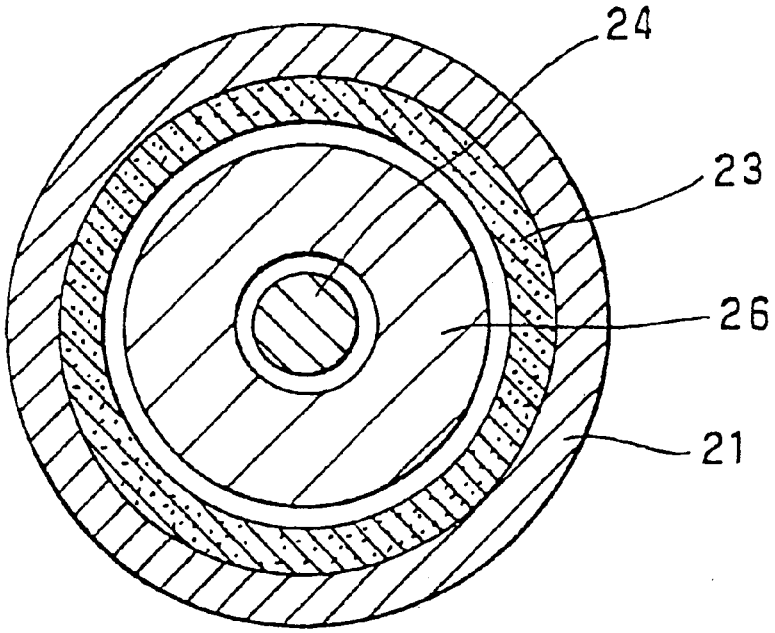
FIG. 6 B (PRIOR ART)

The diaphragm fixing sections 6 and 6 are normally erected in a body with the diaphragm fixing section erecting section 8 and 8 of the yoke 1 and have a stop hole 9 for fixing the diaphragm 5 at the center thereof. The diaphragm 5 (see FIG. 5) has a shape in which it protrudes in four directions similarly to the yoke 1 in FIG. 4. It has through holes 10 and 10 corresponding to the stop holes 9 at the upper and lower protrusions in FIG. 5 and has a center opening 11 which is long in the horizontal direction in FIG. 5. The diaphragm 5 is fixed onto the diaphragm fixing section 6 and 6 by screws or vises via the spacer 12.

A plate yoke 13 is attached to the diaphragm 5. The plate yoke 13 extends along the center opening 11. Its part positioned within the center opening 11 is thickened and it is normally structured so that its upper surface becomes flat with the diaphragm 5. Its thin parts at the both ends are fixed to the back of the diaphragm S by means of brazing for example. That is, the plate yoke 13 is fixed to the diaphragm 5 only by the thin parts at the both ends thereof and the center thick part is enabled to vibrate within the center opening 11.

Normally two tap holes 14 are created through the center thick part of the plate yoke 13 and the whole speaker is fixed to a housing 15 by screwing screws 16 thereto in building into the housing 15. The housing 15 is structured so as to be separable as top and bottom parts.

The main body of the bone-conduction speaker is fixed in the floating state within the housing 15 via the plate yoke 13. Thus, it becomes possible to realize the efficient bone-conduction speaker because vibrations generated when sounds or audio input signals are applied are transmitted effectively to the housing 15.

As described above, according to the invention, the magnet and the diaphragm fixing section are disposed on the same circumference, not in double concentrically like the conventional one, so that their installation space may be reduced to a half, thus enabling the diameter of the center magnetic pole to be increased and a number of turns of the voice coil to be increased. Accordingly, the inventive bone-conduction speaker has an effect that the efficiency may be enhanced without enlarging the size of the outer diameter as compared to the conventional ones.

Still more, the inventive bone-conduction speaker has the simple structure, thus bringing about effects that it can be readily produced by fixing the diaphragm to the yoke that it can be readily produced by fixing the diaphragm to the yoke just by screwing via a spacer for example and that it is fully strong in terms of strength.

What is claimed is:

1. A bone-conduction speaker consisting of:

a yoke having a magnetic pole at a center thereof;

a voice coil wound around said magnetic pole;

the yoke extending in a plane in four directions beyond a perimeter of said coil and forming a first pair of opposing seats and a second pair of opposing seats;

at least pair of magnets respectively fixed to said first pair of opposing seats;

a pair of diaphragm fixing sections respectively formed as a unit with said second pair of opposing seats; and a diaphragm fixed directly to said pair of diaphragm fixing sections so as to be spaced apart from said yoke, said voice coil and said pair of magnets.

2. The bone-conduction speaker according to claim 1, wherein said pair of magnets and said diaphragm fixing sections are located on one and the same circumference of the yoke.

3. The bone-conduction speaker according to claim 1, wherein said diaphragm has an opening at a center thereof and a plate yoke which can vibrate is fixed in said opening.

4. The bone-conduction speaker according to claim 3, wherein the plate yoke is fixed to the diaphragm and to a surface of a housing for said bone-conduction speaker.

5. The bone-conduction speaker according to claim 4, wherein a surface of the diaphragm is co-planar with a surface of the plate yoke fixed to the housing.

6. The bone-conduction speaker according to claim 4, wherein the plate yoke is fixed to the diaphragm at two opposing points.

7. The bone-conduction speaker according to claim 1 wherein each of said pair of magnets has a rectangular parallelepiped shape.

8. The bone-conduction speaker according to claim 1, wherein each of said pair of diaphragm fixing sections has a spacer abutting said diaphragm.

* * * * *